US005143119A

United States Patent [19]

Plangger

[11] Patent Number: 5,143,119

[45] Date of Patent: Sep. 1, 1992

[54] DRIVE FOR A FEED VALVE

[75] Inventor: Rico Plangger, Turgi, Switzerland

[73] Assignee: Asea Brown Boveri Ltd., Baden, Switzerland

[21] Appl. No.: 626,983

[22] Filed: Dec. 13, 1990

[30] Foreign Application Priority Data

Dec. 21, 1989 [CH] Switzerland ..... 4574/89

[51] Int. Cl.[5] ..... F15B 19/00; F16K 37/00

[52] U.S. Cl. ..... 137/557; 73/168; 251/29; 251/30.01

[58] Field of Search ..... 73/168; 137/557; 251/29, 30.01

[56] References Cited

U.S. PATENT DOCUMENTS 3,429,180 2/1969 Vind ..... 73/168
4,001,654 1/1977 Davis et al. .
4,637,587 1/1987 Kuhnlein ..... 251/29

FOREIGN PATENT DOCUMENTS 3138561 4/1983 Fed. Rep. of Germany .
448131 3/1968 Switzerland .
666132 6/1988 Switzerland .

*Primary Examiner*—Gerald A. Michalsky
*Attorney, Agent, or Firm*—Oblon, Spivak, McClelland, Maier & Neustadt

[57] ABSTRACT

A drive for a feed valve having an actuating line and a device for controlling the pressure in the actuating line. The device comprises three valves connected to one another to form a hydraulic auctioneering circuit. The drive is suitable for a comparatively high oil pressure, and the drive is provided with a test system which monitors the operativeness of the drive. The test system is pressurized by the device, and a pressure drop can be sensed in the test system by a sensor.

6 Claims, 5 Drawing Sheets

DRIVE FOR A FEED VALVE

BACKGROUND OF THE INVENTION

1. Field of the invention

The invention is based on a drive for a feed valve having an hydraulically pressurized actuating line and having a device for controlling the pressure in the actuating line which has three valves connected to one another to form an hydraulic auctioneering circuit.

2. Discussion of background

The Patent CH 666 132 discloses a drive for a feed valve. This drive which is operated with oil under comparatively low pressure actuates, for example, a quick-acting gate valve which serves as feed valve for feeding steam into a turbine. The oil under pressure or a different hydraulic fluid acts on the drive via an actuating line so that said drive can open or close the feed valve. The pressure in the actuating line is controlled via a device which has three valves connected to one another to form an hydraulic auctioneering circuit. These valves are constructed as electromagnetically actuated sliding valves and the operativeness of each is monitored separately so that three monitoring circuits are necessary. These monitoring circuits have mechanical contacts which require servicing. This device is less suitable for use at higher pressures.

SUMMARY OF THE INVENTION

The invention aims to remedy this. The invention, as characterized in the claims, solves the problem of providing a drive for a feed valve which is suitable for comparatively high pressure of the driving oil and the operativeness of which can be monitored with simple means.

The advantages achieved by means of the invention are essentially to be seen in the fact that with higher oil pressures better dynamics of the drive can be achieved. A compact design of the drive is possible. The monitoring of the operativeness can occur more simply and be less prone to failure, since it requires no mechanical contacts.

The further embodiments of the invention are subjects of the dependent claims.

The invention, its further development and the advantages achievable therewith are explained in greater detail below with reference to the drawings which only illustrate one possible embodiment.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
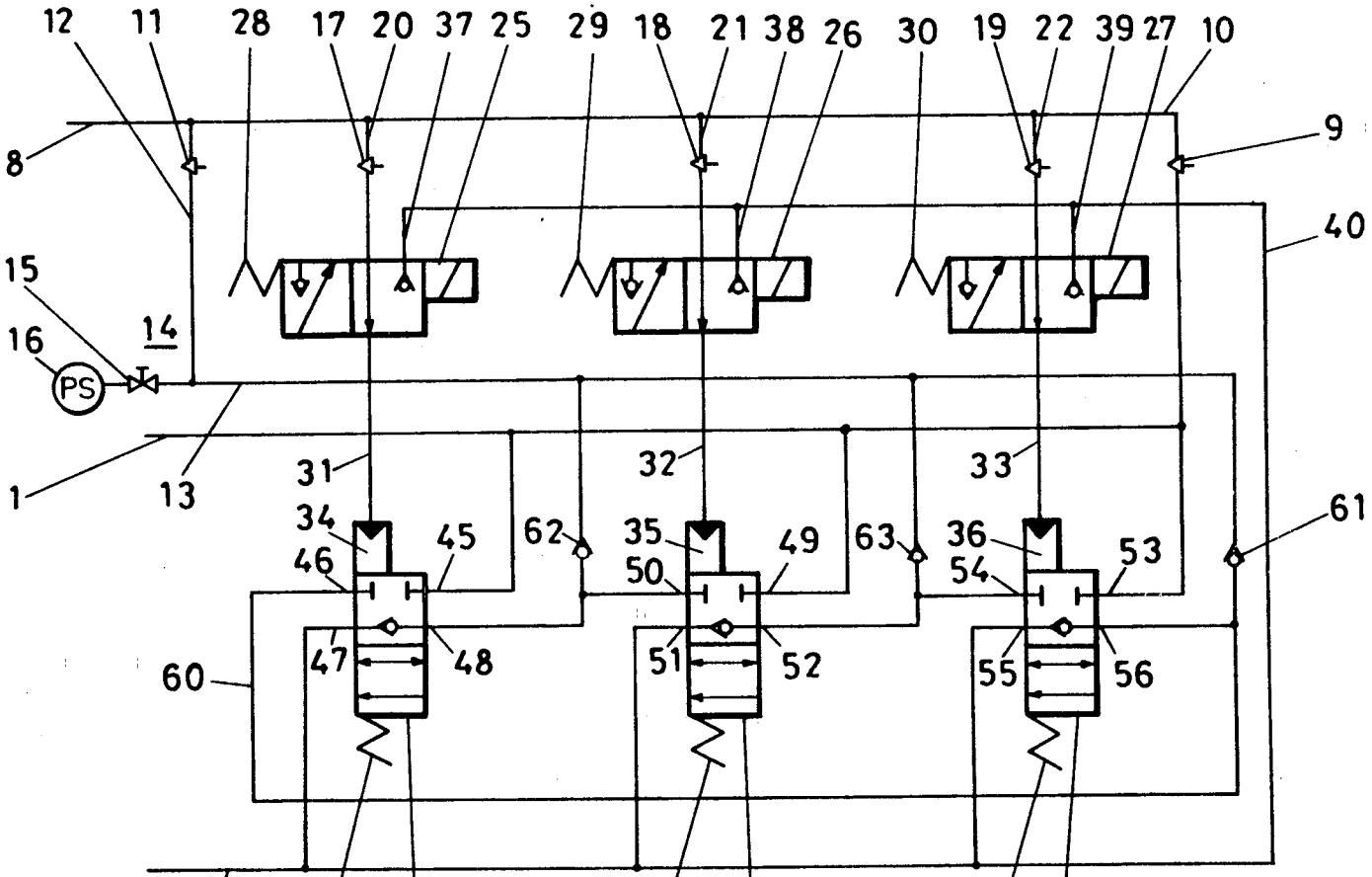
FIG. 1 shows a first basic outline of a part of the drive.

Referring now to the drawings, wherein like reference numerals designate identical or corresponding parts throughout the several views, FIG. 1 shows a basic outline of a part of the drive, and namely that part is illustrated which comprises a device for controlling the pressure in an actuating line 1. Usually, oil is used as a medium for transmitting this pressure; however, a different hydraulic fluid or even a gaseous medium can also be used for this purpose. Via this actuating line 1, a cylinder-piston arrangement (not illustrated) of the drive which opens or closes the associated feed valve (also not illustrated) is actuated. Usually, when full pressure is present in the actuating line 1 this feed valve will be open and as soon as the pressure drops it will quickly close.

This device for controlling the pressure has three valves 2, 3 and 4 of identical design connected together to form an hydraulic auctioneering circuit. The oil pressurized by a pump (not illustrated) passes into this device through an inlet 8. During this process, pressures in the region of 160 bar are used. From the inlet 8 oil is fed under pressure directly into the actuating line 1 via a line 10 provided with an orifice plate 9, the orifice plate 9 determining the flow rate of the oil. A further line 12 provided with an orifice plate 11 feeds a small quantity of oil under pressure into a line 13 of a test system 14. The line 13 feeds a pressure control device 16 via a shut-off element 15. The shut-off element 15 is usually only closed if the pressure control device 16 is being inspected. The pressure control device 16 can contain, for example, a piezoelectric measuring element which operates without mechanical contacting and therefore requires practically no servicing. The pressure control device 16 responds when a set minimum pressure value is undershot and transmits an electrical signal to a master system control (not illustrated) where this signal is further processed.

Via three further lines 20, 21 and 22, each provided with an orifice plate 17, 18 and 19 limiting the throughflow, three solenoid valves 25, 26 and 27 are each fed from the inlet 8. In FIG. 1, the solenoid valves 25, 26, 27 are illustrated in a magnetically excited state, in the event of a failure of the electrical power or if it is switched off, the solenoid valves 25, 26, 27 are pressed into a second position, shown in outline, by in each case a spring 28, 29 and 30 indicated diagrammatically. The solenoid valves 25, 26, 27 can be for example seat valves of the type M-SEW6 from the company Mannesmann Rexroth GmbH, D 8770 Lohr a.M. In the position illustrated the oil flows under pressure through the solenoid valves 25, 26, 27 into a line 31, 32 and 33 in each case, which each lead into a diagrammatically illustrated drive volume 34, 35 and 36 of the valves 2, 3, 4. The drive volume 34 is assigned to the valve 2, the drive volume 35 to the valve 3 and the drive volume 36 to the valve 4. In each case a further outlet 37, 38 and 39 of the solenoid valves 25, 26, 27 is connected via a common line 40 to an outlet 41. However, in the valve position illustrated oil does not flow through the outlets 37, 38, 39.

The valves 2, 3, 4 are constructed as double valves and, to be precise, each have a seat valve and a sliding valve, the design is explained later in greater detail in conjunction with FIG. 5. The valves 2, 3, 4 are illustrated in FIG. 1 with drive volumes 34, 35, 36 pressurized in each case, if the supply with oil under pressure through the respective lines 31, 32, 33 should not occur, the valves 2, 3, 4 are pressed into a second switching position (illustrated in FIG. 1) in each case by strong springs 42, 43 and 44. It is thus ensured that the valves always assume a defined switching position even in the event of any possible fault. Each of the valves, 2, 3, 4 has, in addition to the line 31, 32, 33 feeding the respective drive volume 34, 35, 36, four further ports for oil lines. The valve 2 has the ports 45, 46, 47 and 48. The valve 3 has the ports 49, 50, 51 and 52. The valve 4 has the ports 53, 54, 55 and 56.

The port 45 of the valve 2 is connected to the actuating line 1 and separated from the port 46 by a diagrammatically indicated sliding valve. The port 46 is connected to the line 13 of the test system 14 via a line 60 in which a non-return valve 61 is mounted. The non-return valve 61 is arranged in such a way that an oil flow out of the test system 14 is possible. The port 47 is connected to the outlet 41. Between the ports 47 and 48 the operating symbol for a seat valve is drawn inside the valve 2. In this switching position no oil through-flow is possible in either direction between the two ports 47 and 48, since there is always a lower pressure on the side of the outlet 41. The port 48 is connected via a non-return valve 62 to the line 13 of the test system 14. The non-return valve 62 permits a flow of oil out of the test system 14.

The port 49 of the valve 3 is connected to the actuating line 1 and it is separated from the port 50 by an indicated sliding valve. The port 50 is connected to the port 48 of the valve 2 and at the same time via the non-return valve 62 to the test system 14. The port 51 is connected to the outlet 41. In this switching position the connection between the ports 51 and 52 is shut off by an indicated seat valve. The port 52 is connected via a non-return valve 63 to the line 13 of the test system 14. The non-return valve 63 permits a flow of oil out of the test system 14.

The port 53 of the valve 4 is connected to the actuating line 1 and is separated from the port 54 by an indicated sliding valve. The port 54 is connected to the port 52 of the valve 3 and at the same time via the non-return valve 63 to the test system 14. The port 55 is connected to the outlet 41. In this switching position the connection between the ports 55 and 56 is shut off by an indicated seat valve. The port 56 leads into the line 60 ahead of the non-return valve 61, so that the port 56 is operatively connected via this non-return valve 61 to the test system 14.

Figure 2:
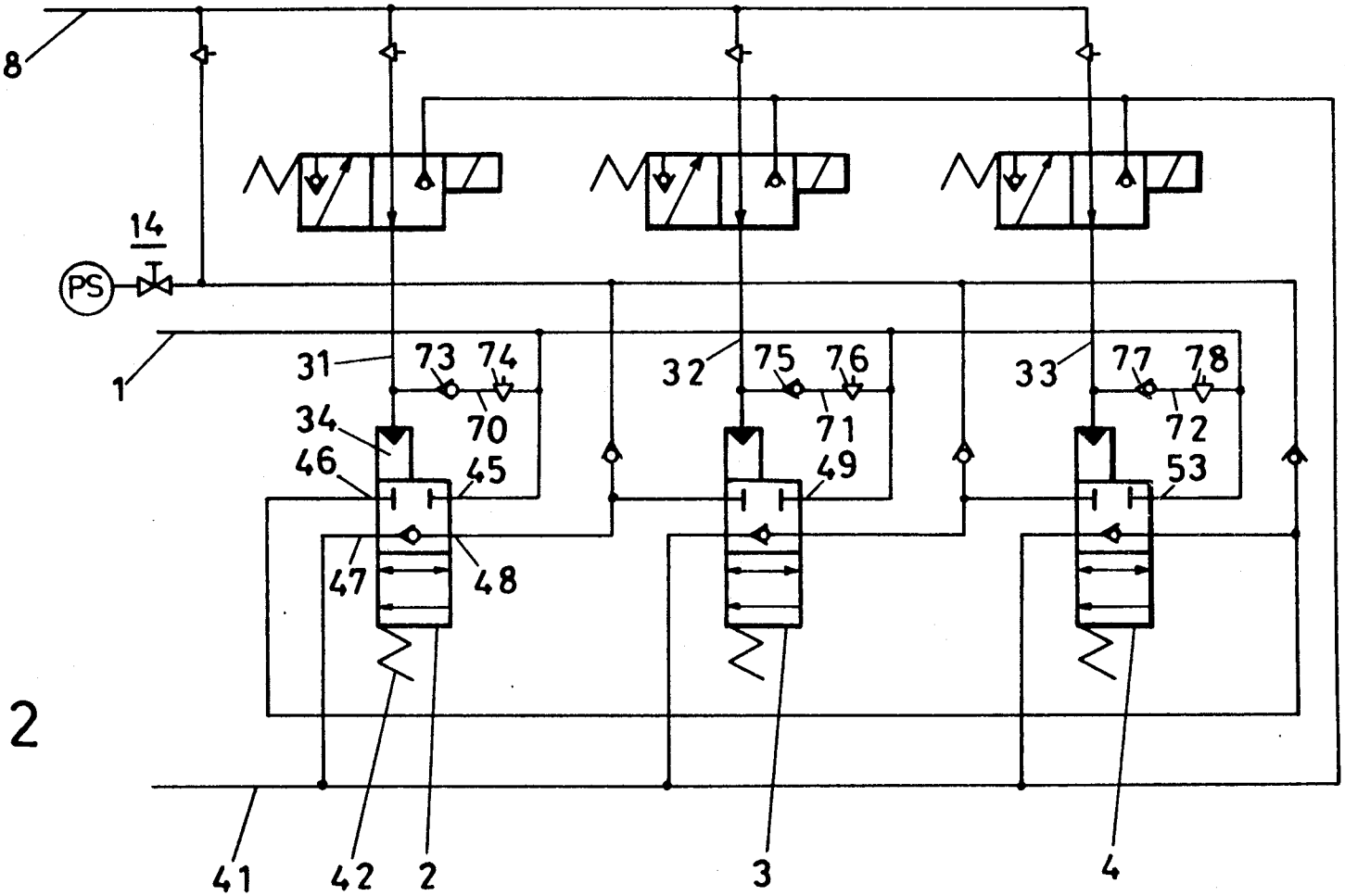
FIG. 2 shows a second basic outline of a part of the drive.

The basic outline according to FIG. 2 differs from FIG. 1 only in the fact that the line 10 and the orifice plate 9 are replaced by three lines 70, 71 and 72. The advantages of this arrangement will be discussed later. The line 70 connects the line 31 to the port 45 of the valve 2 and at the same time to the actuating line 1. Installed in the line 70 there is a non-return valve 73 which permits a flow of oil from the line 31 in the direction of the actuating line 1, the quantity of flowing oil being limited by an orifice plate 74 also provided in the line 70. The line 71 connects the line 32 to the port 49 of the valve 3 and at the same time to the actuating line 1. Installed in the line 71 there is a non-return valve 75 and an orifice plate 76 so that a flow of oil from the line 32 in the direction of the actuating line 1 is possible. The line 72 connects the line 33 to the port 53 of the valve 4 and at the same time to the actuating line 1. Installed in the line 72 there is a non-return valve 77 and an orifice plate 78 so that a flow of oil from the line 33 in the direction of the actuating line 1 is possible.

Figure 3:
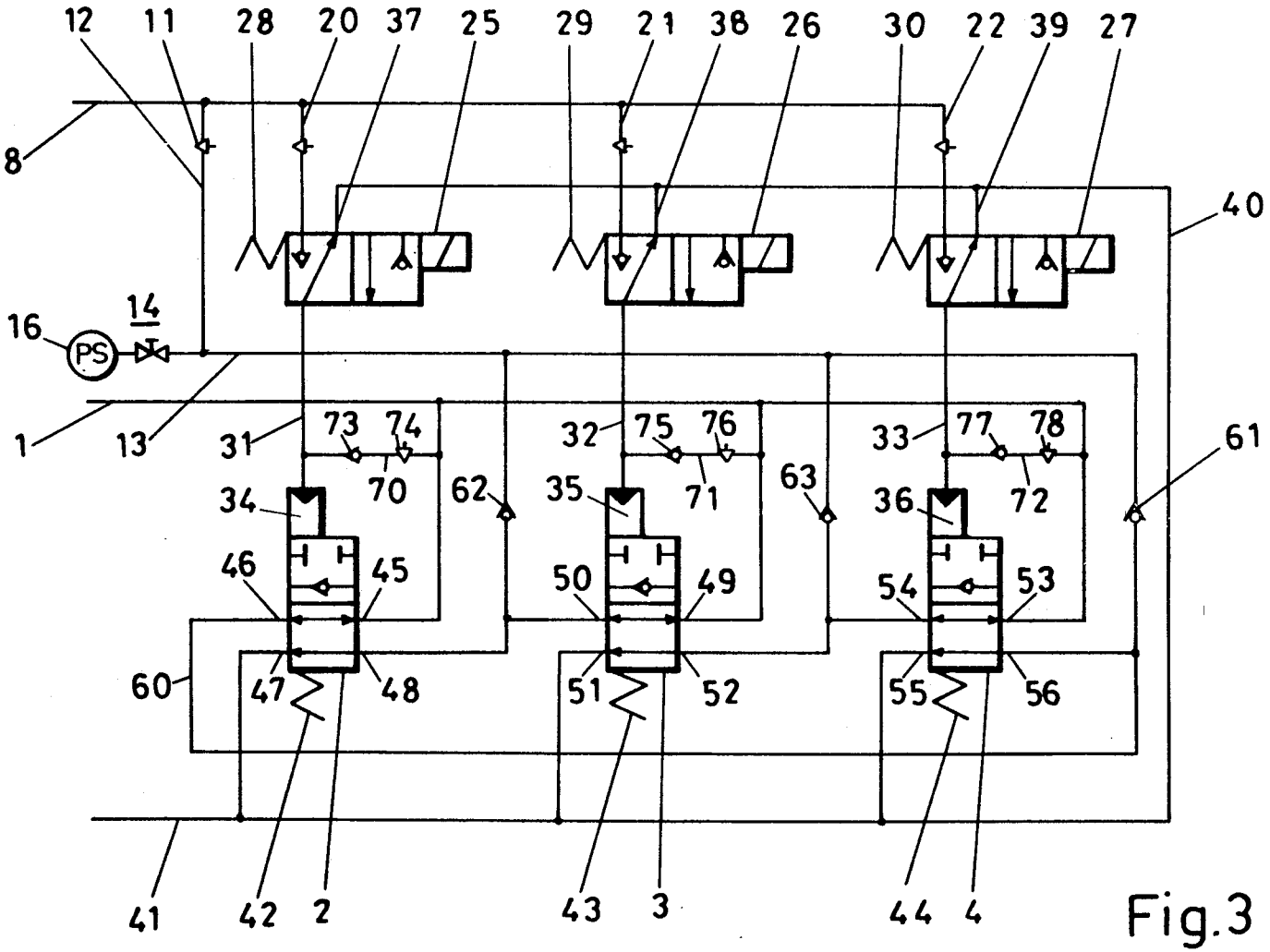
FIG. 3 shows a third basic outline of a part of the drive.

The basic outline according to FIG. 3 corresponds to the outline according to FIG. 2, only the solenoid valves 25, 26, 27 have a second switching position and as a result the valves 2, 3 and 4 actuated by them do also. The solenoid valves 25, 26, 27 are illustrated here in the switching position into which they are pressed by the respective springs 28, 29, 30 when the electrical power for the magnetic excitation fails or is switched off. The three lines 31, 32 and 33 are released from oil pressure by the solenoid valves 25, 26, 27 and the line 40 to the outlet 41, and thus the three drive volumes 34, 35, 36 are also emptied and the springs 42, 43, 44 press the valves 2, 3, 4 into the switching position illustrated in FIG. 3.

Figure 4:
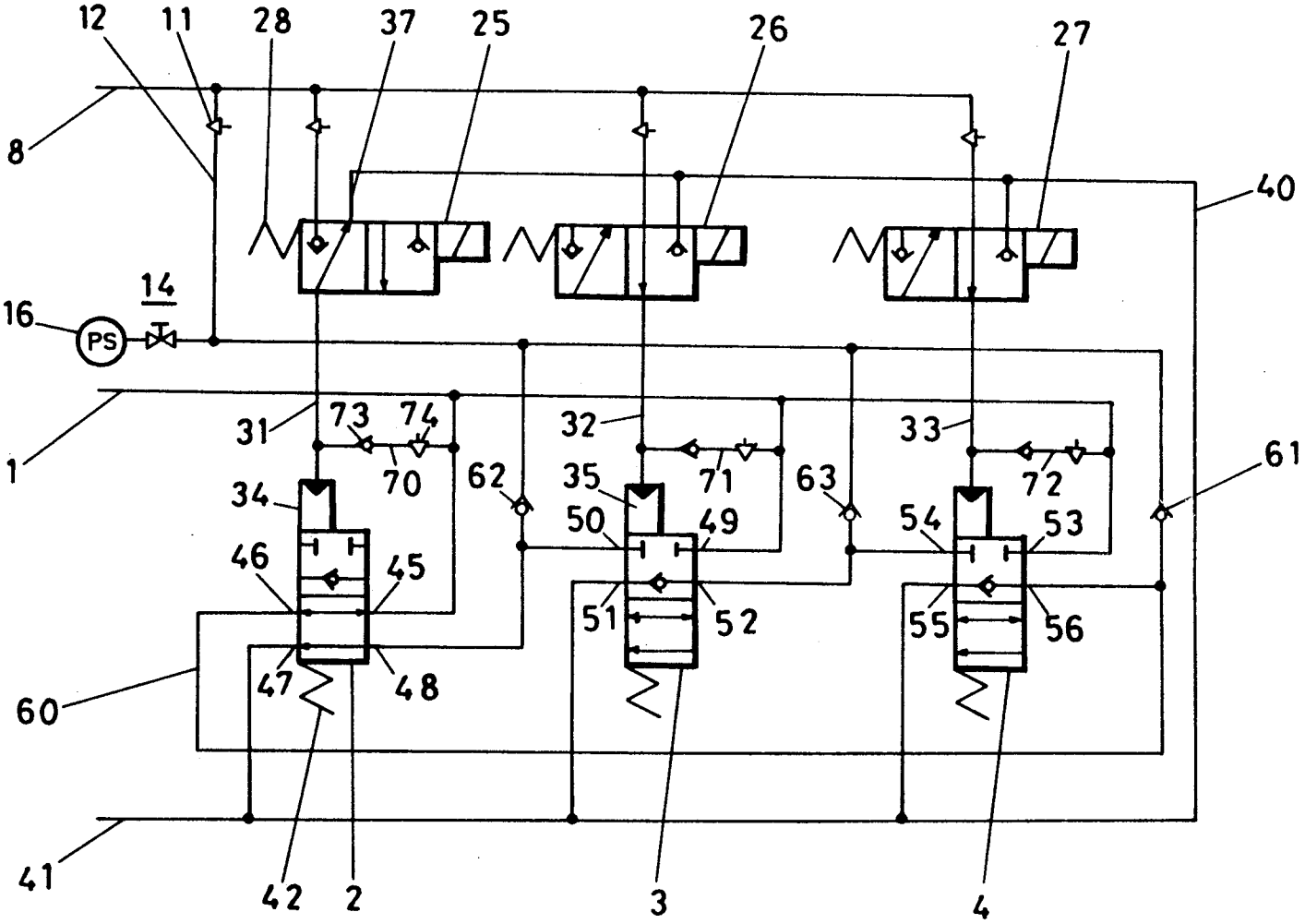
FIG. 4 shows a fourth basic outline of a part of the drive.

The outline in FIG. 4 shows a possible operating state of the device. The valves 3 and 4 are switched as in FIG. 2, the valve 2 is switched analogously to FIG. 3. This position of the valve 2 can be produced intentionally by switching off the power for the magnetic excitation of the associated solenoid valve 25, as a result of which, as already described, the drive volume 34 is relieved of pressure, which results in the spring 42 pressing the valve 2 to illustrated switching position; however, it is also possible that a genuine fault has occurred which has, for example, disconnected the power supply. An intentional switching off of the power would be carried out if, for example, a functional control of the valve 2 is to be performed.

Figure 5:
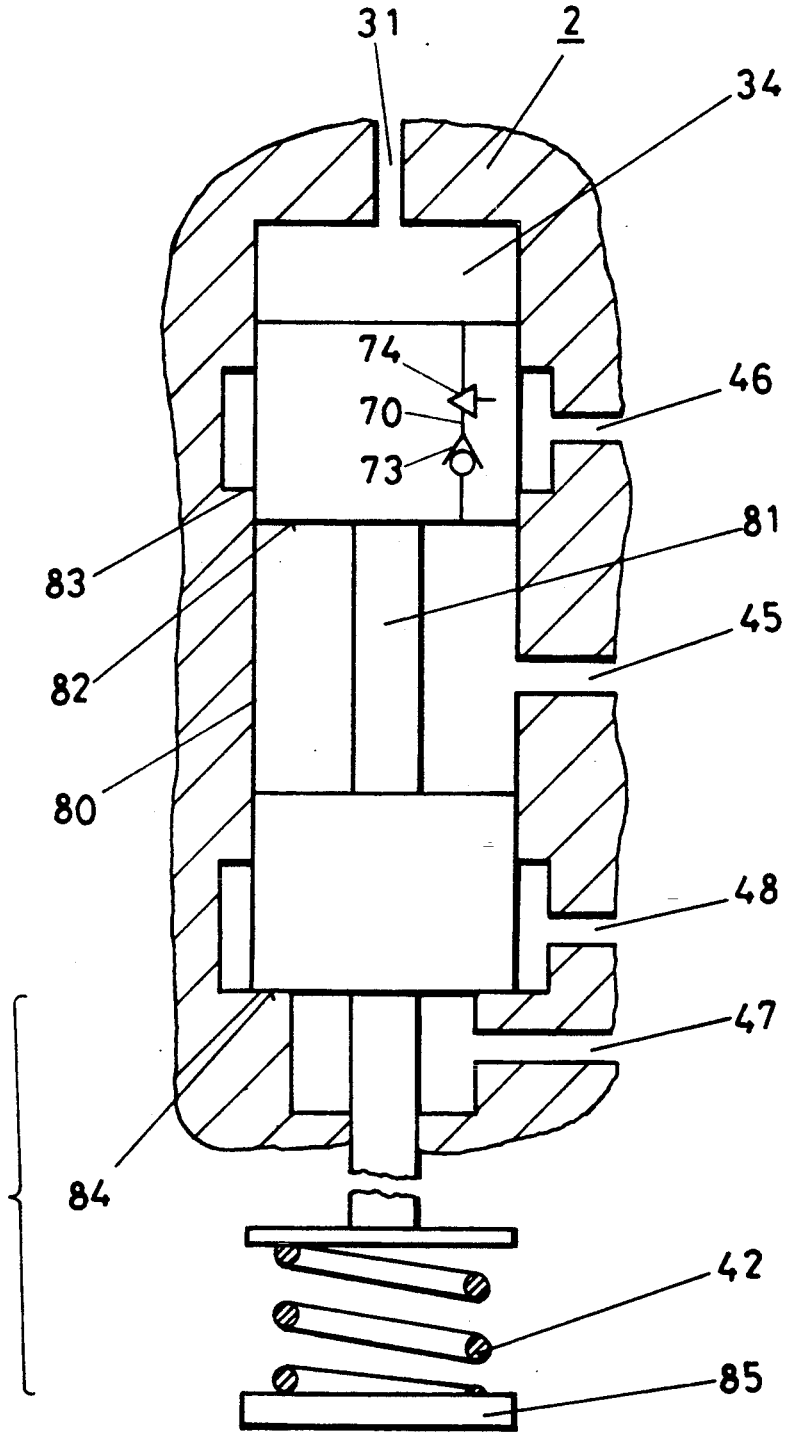
FIG. 5 shows a basic outline of a valve.

FIG. 5 shows a basic outline of the valve 2, the valves 3 and 4 being of identical constructional design, the switching position being the same as shown in FIG. 2. The valve 2 is arranged in a cylindrical bore 80 of an hydraulic block which also comprises the valves 3 and 4. The line 31 leads into the cylindrical drive volume 34. The pressure of the oil in the drive volume 34 acts on a piston 81 which is displaceably arranged in the bore 80. The piston 81 is constructed as one piece, it has two sealing points, namely a sealing edge 82 which cooperates with an edge 83 of the bore 80 when the piston 81 moves upward, and a sealing seat 84. Accordingly, the valve 2 has in the upper part a sliding valve with the sealing edge 82 between the ports 45 and 46 and in the lower part it has a seat valve with the sealing seat 84 between the ports 47 and 48. When opening the valve 2, that is to say when the piston 81 moves upwards, it proves advantageous that the overshooting of the edge 83 by the sealing edge 82 brings about a valve opening of the sliding valve without causing an appreciable change in volume which could lead to inadmissible pressure fluctuations in the adjacent volumes and lines and thus to resulting incorrect actuations of the drive. Indicated in the lower part of the outline there is the spring 42 which pushes the piston 81 upwards into a defined open position after a pressure drop in the drive volume 34. The spring 42 is supported against a support 85.

For the purpose of explaining the mode of operation FIG. 1 will now be considered in closer detail. The valves 2, 3 and 4 and the solenoid valves 25, 26, 27 are operating satisfactorily and the actuating line 1 is under pressure so that the feed valve is kept open. The fault-free normal operation is ensured. Oil is kept under pressure in the actuating line 1 from the inlet 8 via the line 10. The pressure occurring there is in the region of 160 bar. A sealing of the actuating line 1 in respect of the outlet 41 is ensured, and, to be precise, two sealing points connected in series are used for this purpose. The first sealing point is always a sliding valve, for example between the ports 55 and 56 in the valve 2, and the second sealing point connected in series, for example between the ports 55 and 56 in the valve 4, is always a seat valve. The seat valve must in each case also withstand the full pressure which is exerted by the test system 14. For such high pressures it is advantageous to use a seat valve since with this valve type any possible oil decomposition does not entail any negative effects on the operativeness of the valve. The sliding valve is not so highly stressed in each case so that, here too, no negative effects of an oil decomposition are to be feared. The test system 14 is monitored by the pressure control device 16 which only responds and emits a signal when a pressure threshold value is undershot.

In FIG. 2, the actuating line 1 is supplied with oil under pressure via the lines 70, 71 and 72. This arrangement has the advantage that no oil is lost into the outlet 41 when building up the oil pressure in this hydraulic device. Furthermore, the lines 70, 71, 72, as shown by FIG. 5, can be mounted advantageously inside the valves 2, 3, 4, so that additional lines, screw connections and sealing points are not present, which increases reliability. Otherwise the function of the device according to FIG. 2 corresponds to that of the device according to FIG. 1.

In FIG. 3 the so-called "fail safe" position of the device is illustrated. The solenoid valves 25, 26, 27 and the valves 2, 3, 4 are placed in their position of rest. In this position the oil flows under pressure out of the actuating line 1 into the outlet 41, and, to be precise, both through the line which connects the actuating line 1 to the port 45 of the valve 2 and through the corresponding lines which lead to the ports 49 or 53 of the valves 3 or 4 and through the second valve seat connected in each case in series. The feed valve closes with a high degree of reliability so that the turbine fed by this feed valve cannot arrive at an uncontrollable operating state. At the same time the pressure from the test system 14 escapes through the non-return valves 61, 62, 63, so that the pressure control device 16 also reports to the master system control that this unit has been disabled. This "fail safe" position is always obtained since the springs 42, 43, 44 of the valves 2, 3, 4 and the springs 28, 29, 30 of the solenoid valves 25, 26, 27 contain a large mechanical power reserve which presses these valves into the illustrated positions with a high degree of reliability if the oil pressure drops completely or switching off for a total shutdown occurs.

The device operates satisfactorily if all valves 2, 3, 4 and all solenoid valves 25, 26, 27 are fully functional, as described previously. However, the case may now arise that a module of this unit fails. In this case, as shown by FIG. 4, a satisfactory functioning of the drive is also ensured. The pressure in the actuating line 1 is also maintained after the switching off of the valve 2, so that the feed valve remains opened. Only the pressure in the test system 14 is somewhat reduced by the non-return valve 62, since the subsequent feeding by the line 12 is too weak to maintain the complete pressure if one of the non-return valves 61, 62, 63 opens. In this case, the pressure control device 16 reports a pressure drop in the test system 14, which is to be considered as an indication of a fault in the device. A test of the device and of its components is necessary which leads to the localization of the defective parts and their repair. During this service period, an on-going, satisfactory operation of the drive is ensured.

It is also possible to perform corresponding preventative service operations in that, one by one, each of the valves 2, 3, 4 is switched off intentionally by means of the corresponding solenoid valve 25, 26, 27 and is subjected to separate functional tests without the operation of the drive being negatively influenced. The availability of the device is thus to be classified as comparatively high.

However, as soon as two branches of the device are faulty, e.g. the valve 2 and the solenoid valve 26, the valve 2 and the valve 3 are pressed into their position of rest, and the pressure in the actuating line 1 is completely reduced in the direction of the outlet 41 by the line which connects the port 49 of the valve 3 to the actuating line 1. The feed valve consequently closes and a reactivation of the device is not possible until after the clearance of the faults. Likewise, the pressure control device 16 reports a strong pressure drop in the test system 14 so that the master system control can initiate a shutdown of the entire system.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by letters patent of the United States is:

1. A drive for a feed valve comprising:

a hydraulically pressurized actuating line;

means for controlling the pressure in the actuating line, said means for controlling the pressure in the actuating line having first, second and third valves connected to one another;

a test system which is pressurized via fluidic connection with said means for controlling the pressure in the actuating line;

a sensor for sensing a pressure drop in the test system, and a non-return valve provided in a connecting line between each of said first, second and third valves and the test system, each said non-return valve permitting a through-flow from said test system toward each of said first, second, and third valves, respectively.

2. A drive as claimed in claim 1, wherein each of said first, second, and third valves is designed to be hydraulically activated, and first, second, and third solenoid valves are provided for the hydraulic activation, said first, second and third solenoid valves being connected to said first, second, and third valves, respectively.

3. A drive as claimed in claim 2, wherein the actuating line is connected to the respective connection between said first, second, and third solenoid valves and said first, second, and third valves by means of first, second, and third bypass lines, respectively; and wherein first, second, and third non-return valves are provided in said first, second, and third bypass lines, respectively, said non-return valves permitting a through-flow from the solenoid valves toward the actuating line and each having an orifice plate for limiting the through-flow.

4. A drive as claimed in claim 3, wherein said first, second and third bypass lines are arranged inside said first, second, and third valves, respectively.

5. A drive as claimed in claim 1 or 2, wherein each of said first, second and third valves is constructed as a double valve with a common piston, said common piston having a sealing edge which is part of a sliding valve, and a sealing seat which is part of a seat valve; and wherein said first, second, and third valves are connected to one another in such a way that in the activated state in each case one sliding valve and one seat valve are connected in series, the seat valve always facing an outlet.

6. A drive as claimed in claim 1, wherein the actuating line is pressurized via a direct line provided with an orifice plate.

* * * * *